US010472887B2

(12) United States Patent
Hebeisen et al.

(10) Patent No.: US 10,472,887 B2
(45) Date of Patent: Nov. 12, 2019

(54) QUICK RELEASE WINDOW SHADE SYSTEM

(71) Applicant: MECHOSHADE SYSTEMS, INC., Long Island City, NY (US)

(72) Inventors: Stephen P. Hebeisen, Amawalk, NY (US); Eugene Miroshnichenko, Oceanside, NY (US)

(73) Assignee: MECHOSHADE SYSTEMS, LLC., Middleton, WI (US)

( * ) Notice: Subject to any disclaimer, the term of this patent is extended or adjusted under 35 U.S.C. 154(b) by 260 days.

(21) Appl. No.: 15/421,968

(22) Filed: Feb. 1, 2017

(65) Prior Publication Data

US 2017/0226799 A1 Aug. 10, 2017

Related U.S. Application Data

(60) Provisional application No. 62/291,199, filed on Feb. 4, 2016.

(51) Int. Cl.
*E06B 9/80* (2006.01)
*E06B 9/88* (2006.01)

(52) U.S. Cl.
CPC . *E06B 9/80* (2013.01); *E06B 9/88* (2013.01)

(58) Field of Classification Search
CPC ..... E06B 5/16; E06B 9/74; E06B 9/84; E05F 15/72; E05Y 2900/106; E05Y 2201/502
See application file for complete search history.

(56) References Cited

U.S. PATENT DOCUMENTS 4,513,805 A * 4/1985 Mase ..... E06B 9/80 160/299
4,850,418 A 7/1989 Bresson
5,482,103 A * 1/1996 Burgess ..... A62C 2/242 160/190

(Continued)

FOREIGN PATENT DOCUMENTS

CN 202280414 6/2012
DE 102010054920 6/2011

(Continued)

OTHER PUBLICATIONS

Combined Search and Examination Report dated Jun. 30, 2017 in GB Application No. GB1701836.7.

(Continued)

*Primary Examiner* — Katherine W Mitchell
*Assistant Examiner* — Abe Massad
(74) *Attorney, Agent, or Firm* — Snell & Wilmer, L.L.P.

(57) ABSTRACT

The quick release device may comprise a shade tube, a gear wheel engaging with the shade tube, a pawl removably engaging with the gear wheel and a solenoid configured to activate the pawl. The activation of the pawl disengages the pawl from the pawl wheel and allows the shade tube to rotate. The quick release device may also include a shade tube, a rotating brake plate engaging with the shade tube, a spring configured to apply pressure to the rotating brake plate and a magnet configured to apply magnetism to the spring. In response to the magnet applying magnetism to the spring, the spring contracts and releases pressure on the rotating brake plate and allows the shade tube to rotate.

9 Claims, 5 Drawing Sheets

(56) References Cited

U.S. PATENT DOCUMENTS

| | | | | |
|---|---|---|---|---|
| 6,484,784 | B1 * | 11/2002 | Weik, III | E05F 1/006 160/7 |
| 8,887,791 | B2 * | 11/2014 | Eiterman | G01M 99/008 160/305 |
| 9,241,590 | B2 * | 1/2016 | Clements | A47H 1/14 |
| 2003/0201077 | A1 * | 10/2003 | Mullet | E05D 15/24 160/192 |
| 2011/0005694 | A1 * | 1/2011 | Ng | E06B 9/44 160/311 |
| 2014/0250796 | A1 * | 9/2014 | Daus | B66D 1/02 49/506 |
| 2014/0318719 | A1 | 10/2014 | Hsieh | |

FOREIGN PATENT DOCUMENTS

| | | |
|---|---|---|
| DE | 102012011796 | 12/2013 |
| FR | 2398174 | 2/1979 |
| GB | 1549118 | 7/1979 |
| JP | H0782974 | 3/1995 |
| JP | 2008007981 | 1/2008 |
| JP | 2008231915 | 10/2008 |

OTHER PUBLICATIONS

Search Report dated Aug. 7, 2017 in GB Application No. GB1701836.7.

* cited by examiner

SECTION A-A

QUICK RELEASE WINDOW SHADE SYSTEM

CROSS REFERENCE TO RELATED APPLICATIONS

This disclosure claims priority to, and the benefit of, U.S. Provisional Ser. No. 62/291,199 filed on Feb. 4, 2016 and entitled "Quick Release Window Shade System", which is hereby incorporated by reference in its entirety for all purposes.

FIELD

This disclosure relates to window shade systems, and more particularly, to a quick release system to quickly drop the window shade over a window for security purposes.

BACKGROUND

With the increased threat to safety at certain buildings, a need exists to protect the occupants of a building. The threats may come in the form of workplace retaliation, a shooter, a mentally unstable individual looking for publicity, planned acts of terrorism, random violence or environmental disasters. When any one of these threats are initially detected, the occupants of the building may be protected by obstructing the view from the perpetrator or to the occupants. The occupants may also be protected by incorporating a barrier over the windows to minimize the impact of an outside force entering the building. For example, if a shooter is outside the building, the shooter may try to shoot at people that he can see through the windows. This may occur in schools when the school comes under a "lockdown" due to an eminent threat for life safety. Furthermore, it may be best to shield the view of the outside events from young students inside the building. Moreover, a hurricane may throw objects into windows, so a barrier over the windows may at least partially protect the windows and the occupants behind the windows.

By providing a quick barrier in front of the windows, the occupants may be better shielded or hidden from the outside. However, existing window coverings typically need to be lowered individually, which takes a long time. Moreover, the teacher would be visible to the outside threat when the teacher is trying to lower the various window shades. Motorized window shades may lower the window shades too slowly, the motorized shades may be controlled by a central monitoring system which is not aware of the security breach or the controller may be not conveniently accessible in a central location (or in a safe location). Motorized window coverings additionally draw power during the full cycle of the window covering operation. As such, a need exists for a low-cost remotely-triggerable manual shade designed to facilitate safety.

SUMMARY

The quick release device may comprise a shade tube, a gear wheel engaging with the shade tube, a pawl removably engaging with the gear wheel and a solenoid configured to activate the pawl. The activation of the pawl disengages the pawl from the pawl wheel and allows the shade tube to rotate. The quick release device may also include a shade tube, a rotating brake plate engaging with the shade tube, a spring configured to apply pressure to the rotating brake plate and a magnet configured to apply magnetism to the spring. In response to the magnet applying magnetism to the spring, the spring contracts and releases pressure on the rotating brake plate and allows the shade tube to rotate.

BRIEF DESCRIPTION OF THE DRAWINGS

The features and advantages of the present disclosure will become more apparent from the detailed description set forth below when taken in conjunction with the drawings.

DETAILED DESCRIPTION

The detailed description of various embodiments herein makes reference to the accompanying drawings and pictures, which show various embodiments by way of illustration. While the various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 3C:
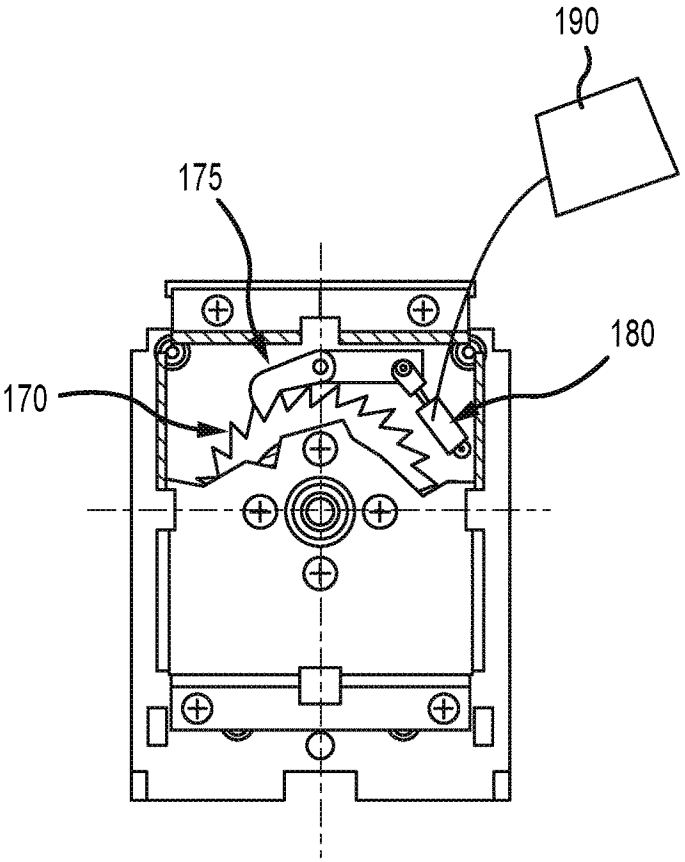
FIG. 3C is a second end view with a cut-away view of an exemplary quick release device including a pawl 175 activated by a solenoid, in accordance with various embodiments.
Figure 3B:
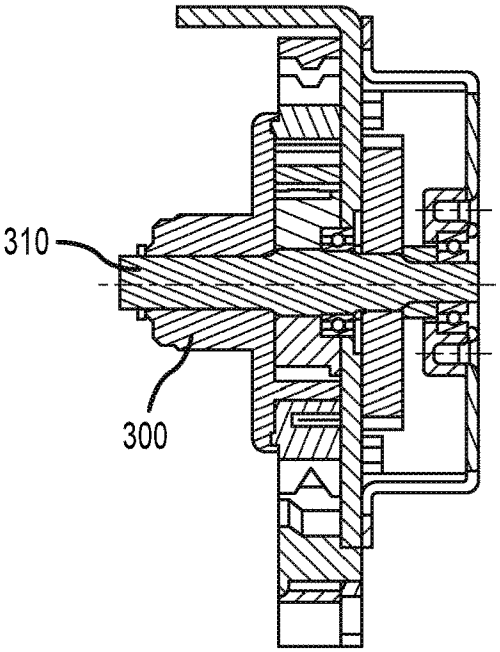
FIG. 3B is a cross-section view of an exemplary quick release device including a pawl 175 activated by a solenoid, in accordance with various embodiments.
Figure 3A:
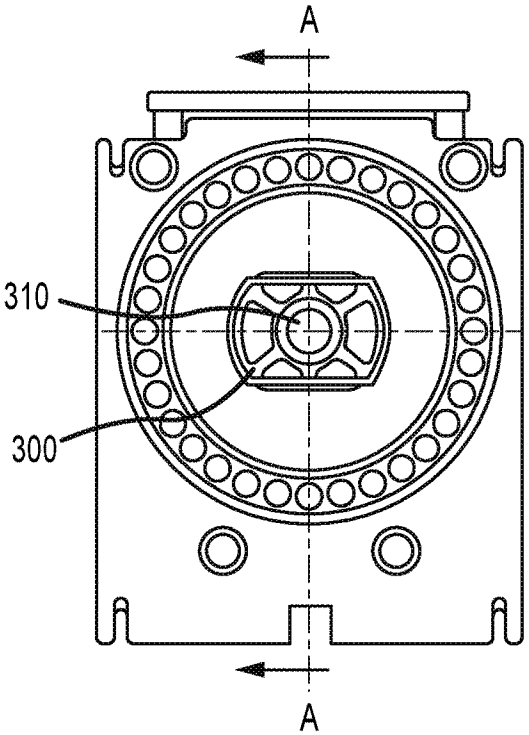
FIG. 3A is a first end view of a bracket showing the hub around the shaft 310 and the circular sprocket that receives the chain, in accordance with various embodiments.

In a drive bracket, a rotating hub 300 may be reciprocally received over a stationary shaft 310, as shown in FIGS. 3A and 3B. In response to a chain being pulled, the sprocket rotates forcing the clutch to open. In response to the clutch opening, the hub rotates. Various features and functions of the manual clutch and shade bracket may be disclosed in, for example, U.S. Pat. No. 6,164,428 filed on Aug. 23, 1999 and entitled "Wrap Spring 120 Shade Operator", which is incorporated by reference in its entirety for all purposes.

Figure 1:
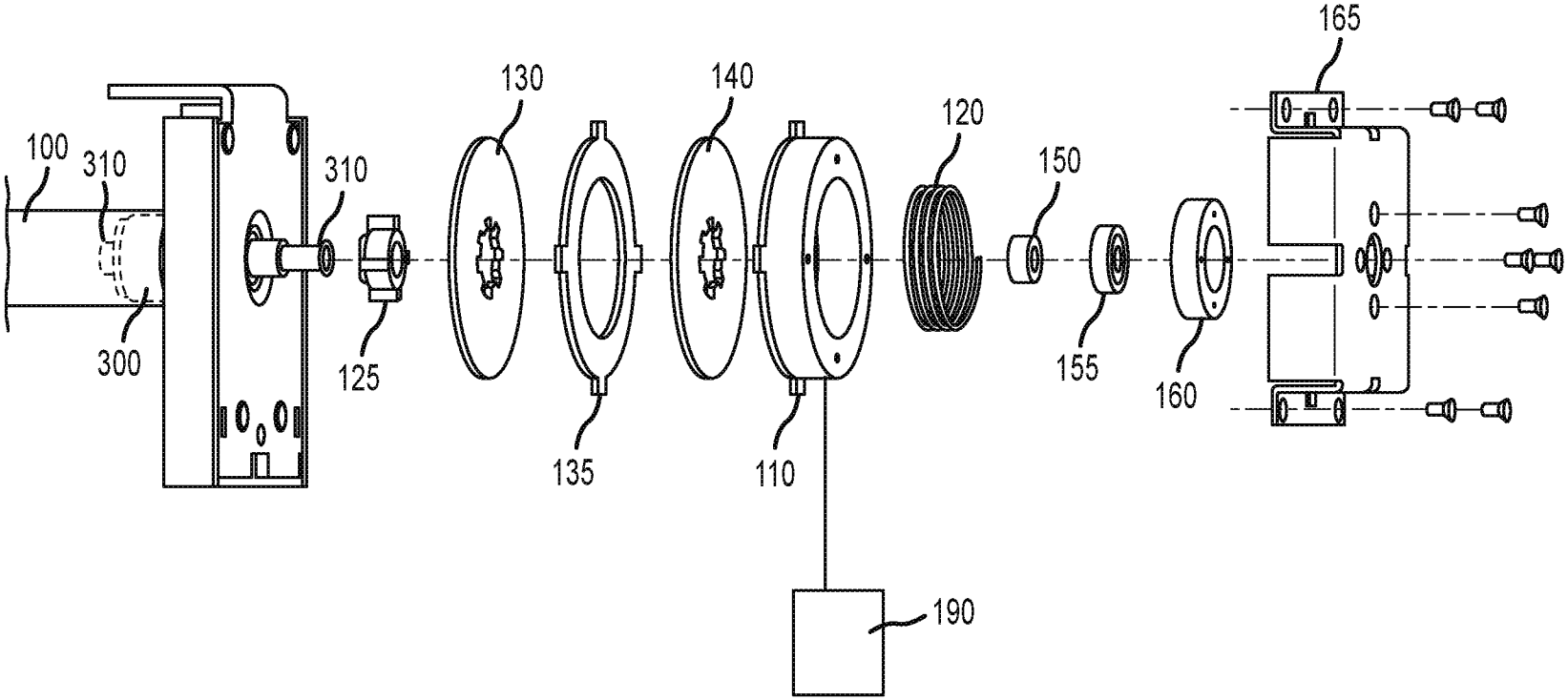
FIG. 1 is an exemplary quick release device including a magnet 110 assembly and brakes, in accordance with various embodiments.

The system may include electromagnetic components to disengage the clutch. With respect to FIG. 1, and in various embodiments, the entire (or any portion of the) brake mechanism with an electromagnet 110 may be built outside of the tube assembly and on the back side of the shade drive-end bracket (the side opposite the shade tube 100) because the shaft 310 has been extended through the bracket. The quick release components may be mounted over the shaft 310 that extends out the back of the bracket. The quick release assembly may generally include a magnet 110, a spring 120 and brake plates 130, 135, 140. In more detail, the quick release assembly may include, for example, a gear 125, a first rotating brake plate 130, a stationary brake plate 135, a second rotating brake plate 140, a magnet assembly 110, a spring 120, a spacer 150, a bearing 155, a bearing housing 160 and a back plate 165. In various embodiments, the magnet 110 disengages a clutch, thereby allowing the shaft 310 to rotate and the shade to partially or fully fall. In particular, in response to the magnet 110 being activated, the spring 120 contracts. The spring 120 contracting removes pressure from the rotating brake plates 130, 140, thereby allowing the shaft 310 to rotate and the shade to partially or fully fall.

Figure 2:
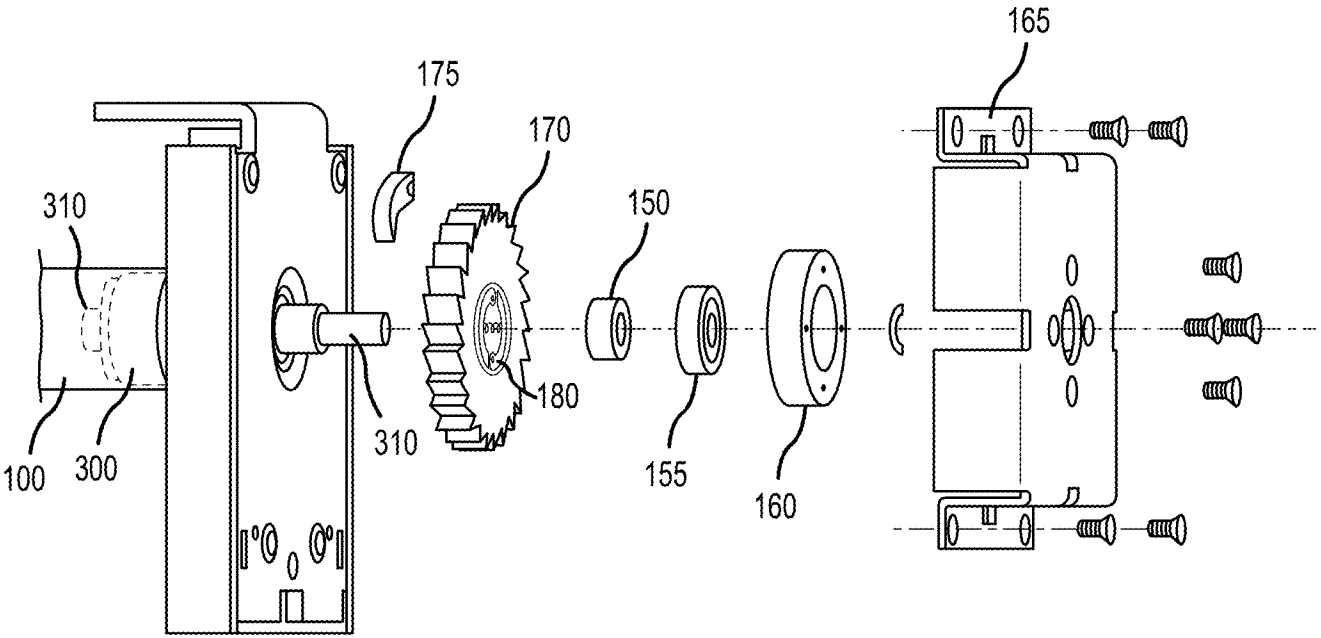
FIG. 2 is an exemplary exploded view of a quick release device including a pawl 175 activated by a solenoid, in accordance with various embodiments.
Figure 4:
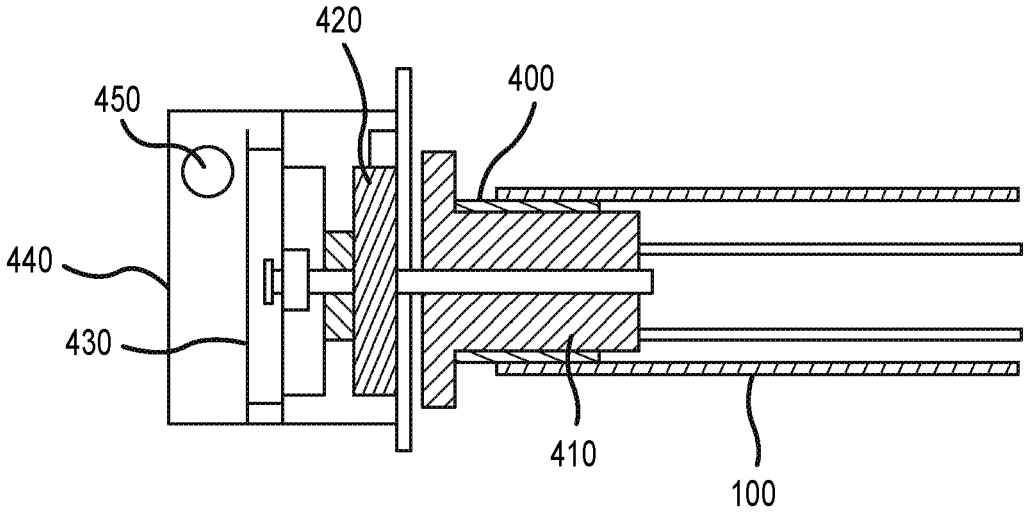
FIG. 4 is a more detailed cross-section view of an exemplary quick release device including a pawl 175 activated by a solenoid, in accordance with various embodiments.
Figure 5:
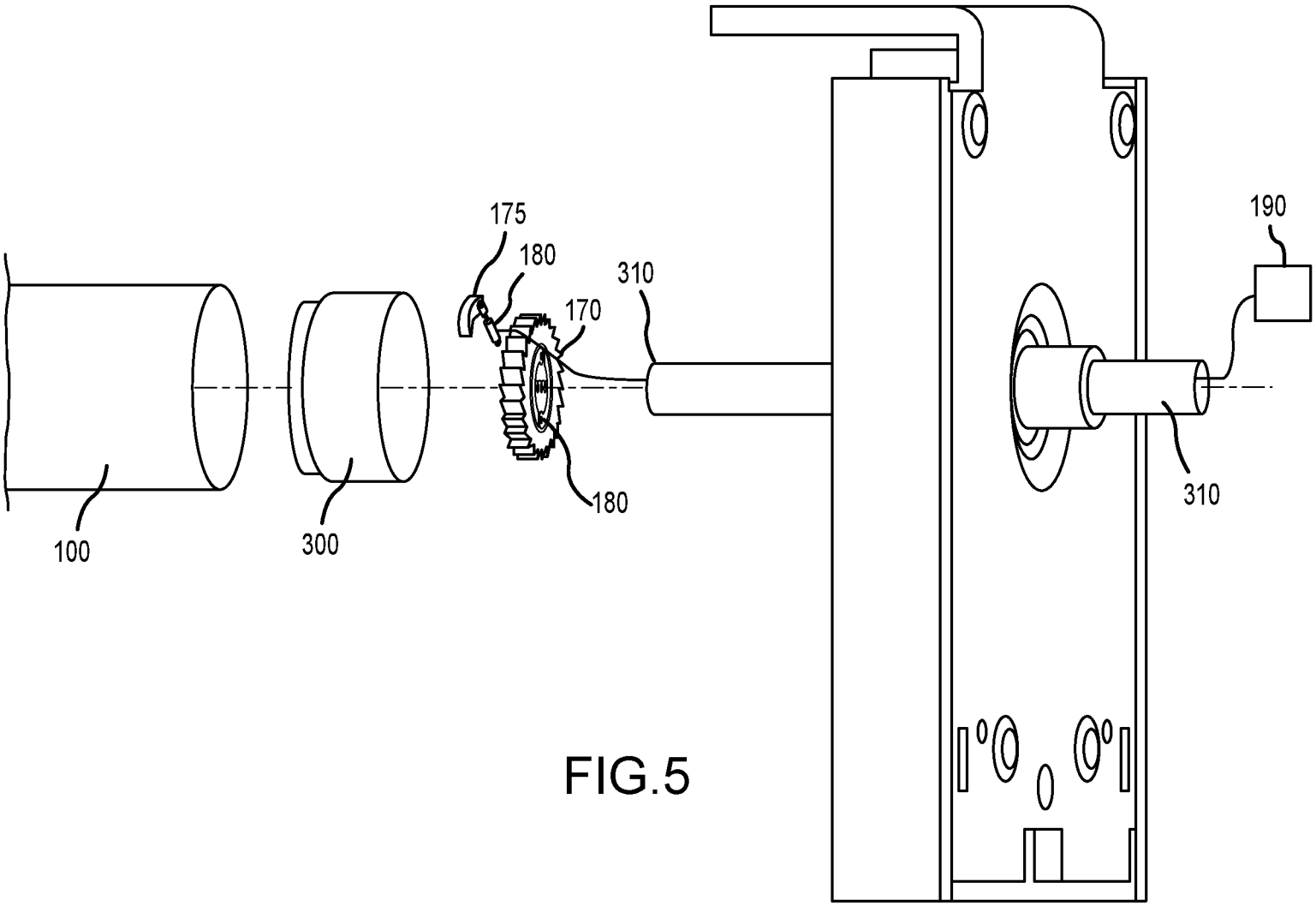
FIG. 5 is an exemplary exploded view of a quick release device including a pawl, gear wheel and dampening brake mechanism within the shade tube, in accordance with various embodiments.

In various embodiments, with respect to FIGS. 2-4, the system may include a re-settable latch mechanism which is electronically released. A shaft 310 may couple to the shade tube 100 (e.g., on a first side of the bracket, as shown in FIG. 3A). The shaft 310 may couple to a gear/pawl 175 wheel 170 (e.g., on a second side of the bracket, as shown in FIG. 3C). A pawl 175 may engage the gear wheel 170 to prevent or restrict the gear wheel 170 from rotating. As shown in FIG. 3C, an activation device 180 (e.g., solenoid) may interface with the pawl 175. In response to activation, the pawl 175 may allow the gear wheel 170 to be released. Releasing the gear wheel 170 allows shaft 310 to rotate and the shade to fall.

The shade may fall all the way down or the shade may fall until the hembar hits the window sill. In various embodiments, the system may include a pre-set that causes the shade to stop at a particular location. The system may have pre-sets at multiple locations. The system may stop the shade at a first pre-set, then move the shade down (or up) to second pre-set, etc. Such pre-sets may be based on the type of security or safety issue. For example, if the security threat is due to a sniper from the top of another building, the shade may only need to go down to a first pre-set that is 75% coverage down from the top of the window. This would allow the occupants to see the police for directions, yet hide the occupants from the shooter's view. If the security threat is a hurricane, then the shade may need to be closed all the way.

The energy to release the pawl 175 from the gear wheel 170 may be much less than the energy to activate a magnet 110 for releasing a clutch. In this manner, power consumption may be reduced by only including a momentary trigger on the latch (e.g., pawl 175) which enables the shade to free-fall (in contrast to the additional power needed to activate the battery). A human may manually pull the shade back up re-engaging the manual clutch again by way of a mechanical feature that pushes the pawl 175 (or some other similar device) back into the latch mechanism to reset the latch until the next trigger. This approach should be far lower in power consumption because it is not holding the load. The system positions a latch which holds the load, and the system operates for a fraction of the time of other electromagnetic systems. With the reduced power needs, in various embodiments, the system may include a power source 190 of a low profile solar panel for powering the trigger mechanism and RF electronics. Moreover, in various embodiments, the system may include a power source 190 which may be a reasonably sized battery for many years of operation before replacement is necessary.

With respect to FIG. 4, in various embodiments, the clutch 410 and shade tube 100 may be coupled directly. The system may not include the quick release coupling assembly within the clutch/tube interface. The shade tube 100 reciprocally receives the clutch 410. In various embodiments, a tube adaptor 400 may exist between the clutch 410 and the shade tube 100. In various embodiments, a bushing may exist between the clutch 410 and the shade tube 100. The mechanism essentially makes the manual clutch work or allows the fabric to freefall. In other words, the mechanical clutch is a direct drive to the shade assembly and the quick release allows it to drive or not. The coupling interface 420 can be moved outside the tube 100. The control card 430 may be housed in, and/or on the outside of, the brake mechanism. The control card 430 may also be outside the tube and on the backside of the shade bracket (opposite side from the shade). The control card 430 may communicate (e.g., to the central controller) via RF or via a low voltage communication network. An external controller may drive the brake on and off. The electronics housing 440 may be non-metallic which may promote much better range on RF transmission. The housing also promotes much better accessibility for troubleshooting and replacement of power source 450.

In various embodiments, any of the various quick release coupling assemblies may be on the outside of the drive bracket (e.g., on the side opposite the window shade). Any of the quick release assemblies may not be within the shade tube 100. Moreover, any of the quick release coupling assemblies may be larger than the shade tube, so they may not fit within the shade tube 100. In various embodiments, any of the quick release assemblies may be configured to and be dimensioned to fit within the shade tube 100 and on the shade tube 100 side of the bracket.

In various embodiments, the system may include a dampening brake mechanism 180 in order to control the descent of the shade. The dampening brake may avoid or reduce the need to pulse the quick release device (e.g., electromagnet 110) to slow down the shade. In various embodiments, the system includes a centrifugal clutch (or decelerator) to the idle end of the shade which slows the shade down gradually as it drops. The accelerated rotational speed essentially creates a centrifugal force that can force "brake pads" to "fly" outward that create a frictional force against an external and mating braking surface. In various embodiments, these can be fluid/hydraulic based designs which use viscosity to create the friction. Such a system may be disclosed in, for example, U.S. Pat. No. 4,513,805 by Toso.

In various embodiments, the system may include pulsing the brake to control the descent of the shade. However, such a pulsing system may reduce the lifecycle of the mechanism, as it does not provide a very elegant shade operation as it jolts to a stop every time the brake is pulsed. Furthermore, such a pulsing feature may complicate the application because, under an optimal situation, the control algorithm for the braking mechanism has either a feedback element identifying the speed of descent for the shade (rotational speed or vertical linear speed), or learns the height of the shade (top limit to bottom limit) before it drops and pulses the brake at a pre-programmed rate in order to best control the descent.

The features and configurations discussed herein may help to reduce power, reduce production costs, reduce the need for service and reduce battery replacement. The incorporation of plastic or other non-metallic components may also support the potential for greater radio frequency (RF) range, if RF communication is included. Moreover, the disclosed system and method may reduce or eliminate the amount of extra electrical wiring needed to implement a shade system which significantly reduces costs associated with electrical wiring for a new building and significantly reduces costs for retrofit projects.

A printed circuit board and batteries may be included to receive or reply to a signal (wired and/or wireless). The wireless frequency may include LoRa 868 MHZ, which is long range, low power, low cost and fast wake up. The wireless signal may be two-way, closed loop, send/receive, encrypted and/or unique IP vetting.

The system may be controlled by any control system. The control system may include a building management system, a window management system, a lighting system and/or an environmental tracking system. Such systems may include the SolarTrac® system, developed by MechoShade Systems, Inc. The system may include the features and functions set forth in U.S. Ser. No. 14/692,868 filed on Apr. 22, 2015 and entitled "Automated Shade Control System Utilizing Brightness Modeling", which is incorporated by reference in its entirety for all purposes. Such control may, in addition to activating the quick release mechanism, also notify emergency services (e.g., police, fire, swat team, etc). The control system may also notify a user, teacher, student, administrator or others to manually activate the quick release mechanism or manually lower the shades. More information about window shade notification systems and manual adjustments may be included in, for example, U.S. Ser. No. 62/239,431, entitled "Shade Adjustment Notification System and Method", which is incorporated by reference in its entirety for all purposes.

The control system may include "panic buttons" in each classroom and/or centralized buttons for the principal. The controller may control a particular window shade, a subset of window shades, window shades all facing the same direction and/or all window shades. The control system may also adjust the window shades at different times of the day or quickly lower the window shades at certain times for energy savings, controlling daylighting, controlling lighting, etc. The control system may communicate to the quick release via a network Ethernet. The system may also notify emergency responders. The control system may include controls to close and/or open the shades individually or in certain groups.

The control system may also be any remote device. The system may be activated by any remote device in communication with the system. For example, the system may be activated from a smartphone using an app. In various embodiments, components, modules, and/or engines of the system may be implemented as micro-applications or micro-apps. Micro-apps are typically deployed in the context of a mobile operating system, including for example, a WINDOWS® mobile operating system, an ANDROID® Operating System, APPLE® IOS®, a BLACKBERRY® operating system and the like. The micro-app may be configured to leverage the resources of the larger operating system and associated hardware via a set of predetermined rules which govern the operations of various operating systems and hardware resources. For example, where a micro-app desires to communicate with a device or network other than the mobile device or mobile operating system, the micro-app may leverage the communication protocol of the operating system and associated device hardware under the predetermined rules of the mobile operating system. Moreover, where the micro-app desires an input from a user, the micro-app may be configured to request a response from the operating system which monitors various hardware components and then communicates a detected input from the hardware to the micro-app.

For the sake of brevity, conventional data networking, application development and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical system.

The various system components discussed herein may include one or more of the following: a host server or other computing systems including a processor for processing digital data; a memory coupled to the processor for storing digital data; an input digitizer coupled to the processor for inputting digital data; an application program stored in the memory and accessible by the processor for directing processing of digital data by the processor; a display device coupled to the processor and memory for displaying information derived from digital data processed by the processor; and a plurality of databases. Various databases used herein may include: tenant data; building data, environmental data, occupant data, and/or like data useful in the operation of the system. As those skilled in the art will appreciate, user computer may include an operating system (e.g., WINDOWS® NT®, WINDOWS® 95/98/2000®, WINDOWS® XP®, WINDOWS® Vista®, WINDOWS® 7®, OS2, UNIX®, LINUX®, SOLARIS®, MacOS, etc.) as well as various conventional support software and drivers typically associated with computers.

The present system or any part(s) or function(s) thereof may be implemented using hardware, software or a combination thereof and may be implemented in one or more computer systems or other processing systems. However, the manipulations performed by embodiments were often referred to in terms, such as matching or selecting, which are commonly associated with mental operations performed by a human operator. No such capability of a human operator is necessary, or desirable in most cases, in any of the operations described herein. Rather, the operations may be machine operations. Useful machines for performing the various embodiments include general purpose digital computers or similar devices.

In fact, in various embodiments, the embodiments may include one or more computer systems capable of carrying out the functionality described herein. The computer system includes one or more processors, such as processor. The processor is connected to a communication infrastructure (e.g., a communications bus, cross-over bar, or network). Various software embodiments are described in terms of this exemplary computer system. After reading this description, it will become apparent to a person skilled in the relevant art(s) how to implement various embodiments using other computer systems and/or architectures. Computer system can include a display interface that forwards graphics, text, and other data from the communication infrastructure (or from a frame buffer not shown) for display on a display unit.

Computer system also includes a main memory, such as for example random access memory (RAM), and may also include a secondary memory. The secondary memory may include, for example, a hard disk drive and/or a removable storage drive, representing a floppy disk drive, a magnetic tape drive, an optical disk drive, etc. The removable storage drive reads from and/or writes to a removable storage unit in a well-known manner. Removable storage unit represents a floppy disk, magnetic tape, optical disk, etc. which is read by and written to by removable storage drive. As will be appreciated, the removable storage unit includes a computer usable storage medium having stored therein computer software and/or data.

In various embodiments, secondary memory may include other similar devices for allowing computer programs or other instructions to be loaded into computer system. Such devices may include, for example, a removable storage unit and an interface. Examples of such may include a program cartridge and cartridge interface (such as that found in video game devices), a removable memory chip (such as an erasable programmable read only memory (EPROM), or programmable read only memory (PROM)) and associated socket, and other removable storage units and interfaces, which allow software and data to be transferred from the removable storage unit to computer system.

Computer system may also include a communications interface. Communications interface allows software and data to be transferred between computer system and external devices. Examples of communications interface may include a modem, a network interface (such as an Ethernet card), a communications port, a Personal Computer Memory Card International Association (PCMCIA) slot and card, etc. Software and data transferred via communications interface are in the form of signals which may be electronic, electromagnetic, optical or other signals capable of being received by communications interface. The signals are provided to communications interface via a communications path (e.g., channel). This channel carries signals and may be implemented using wire, cable, fiber optics, a telephone line, a cellular link, a radio frequency (RF) link, wireless and other communications channels.

The terms "computer program medium" and "computer usable medium" and "computer readable medium" are used to generally refer to media such as removable storage drive and a hard disk installed in hard disk drive. The computer program products provide software to the computer system.

Computer programs (also referred to as computer control logic) are stored in main memory and/or secondary memory. Computer programs may also be received via communications interface. Such computer programs, when executed, enable the computer system to perform the features as discussed herein. In particular, the computer programs, when executed, enable the processor to perform the features of various embodiments. Accordingly, such computer programs represent controllers of the computer system.

In various embodiments, software may be stored in a computer program product and loaded into computer system using removable storage drive, hard disk drive or communications interface. The control logic (software), when executed by the processor, causes the processor to perform the functions of various embodiments as described herein. In various embodiments, hardware components such as application specific integrated circuits (ASICs). Implementation of the hardware state machine so as to perform the functions described herein will be apparent to persons skilled in the relevant art(s).

In various embodiments, the server may include application servers (e.g. WEB SPHERE, WEB LOGIC, JBOSS). In various embodiments, the server may include web servers (e.g. APACHE, IIS, GWS, SUN JAVA SYSTEM WEB SERVER).

A web client includes any device (e.g., personal computer) which communicates via any network, for example such as those discussed herein. Such browser applications comprise Internet browsing software installed within a computing unit or a system to conduct online transactions and/or communications. The computing units or systems may take the form of a computer or set of computers, although other types of computing units or systems may be used, including laptops, notebooks, tablets, hand held computers, personal digital assistants, set-top boxes, workstations, computer-servers, main frame computers, mini-computers, PC servers, pervasive computers, network sets of computers, personal computers, such as IPADS®, IMACS®, and MACBOOKS®, kiosks, terminals, point of sale (POS) devices and/or terminals, televisions, or any other device capable of receiving data over a network. A web-client may run MICROSOFT® INTERNET EXPLORER®, MOZILLA® FIREFOX®, GOOGLE® CHROME®, APPLE® Safari, or any other of the myriad software packages available for browsing the internet.

Practitioners will appreciate that a web client may or may not be in direct contact with an application server. For example, a web client may access the services of an application server through another server and/or hardware component, which may have a direct or indirect connection to an Internet server. For example, a web client may communicate with an application server via a load balancer. In various embodiments, access is through a network or the Internet through a commercially-available web-browser software package.

As those skilled in the art will appreciate, a web client includes an operating system (e.g., WINDOWS® NT®, 95/98/2000/CE/Mobile, OS2, UNIX®, LINUX®, SOLARIS®, MacOS, etc.) as well as various conventional support software and drivers typically associated with computers. A web client may include any suitable personal computer, network computer, workstation, personal digital assistant, cellular phone, smart phone, minicomputer, mainframe or the like. A web client can be in a home or business environment with access to a network. In various embodiments, access is through a network or the Internet through a commercially available web-browser software package. A web client may implement security protocols such as Secure Sockets Layer (SSL) and Transport Layer Security (TLS). A web client may implement several application layer protocols including http, https, ftp, and sftp.

As used herein, the term "network" includes any cloud, cloud computing system or electronic communications system or method which incorporates hardware and/or software components. Communication among the parties may be accomplished through any suitable communication channels, such as, for example, a telephone network, an extranet, an intranet, Internet, point of interaction device (point of sale device, personal digital assistant (e.g., IPHONE®, BLACKBERRY®), cellular phone, kiosk, etc.), online communications, satellite communications, off-line communications, wireless communications, transponder communications, local area network (LAN), wide area network (WAN), virtual private network (VPN), networked or linked devices, keyboard, mouse and/or any suitable communication or data input modality. Moreover, although the system is frequently described herein as being implemented with TCP/IP communications protocols, the system may also be implemented using IPX, APPLE® talk, IP-6, NetBIOS®, OSI, any tunneling protocol (e.g. IPsec, SSH), or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, Dilip Naik, Internet Standards and Protocols (1998); JAVA 2 Complete, various authors, (Sybex 1999); Deborah Ray and Eric Ray, Mastering HTML 4.0 (1997); and Loshin, TCP/IP Clearly Explained (1997) and David Gourley and Brian Totty, HTTP, The Definitive Guide (2002), the contents of which are hereby incorporated by reference.

The various system components may be independently, separately or collectively suitably coupled to the network via data links which includes, for example, a connection to an Internet Service Provider (ISP) over the local loop as is typically used in connection with standard modem communication, cable modem, Dish Networks®, ISDN, Digital Subscriber Line (DSL), or various wireless communication methods, see, e.g., Gilbert Held, Understanding Data Communications (1996), which is hereby incorporated by reference. It is noted that the network may be implemented as other types of networks, such as an interactive television (ITV) network. Moreover, the system contemplates the use, sale or distribution of any goods, services or information over any network having similar functionality described herein.

"Cloud" or "Cloud computing" includes a model for enabling convenient, on-demand network access to a shared pool of configurable computing resources (e.g., networks, servers, storage, applications, and services) that can be rapidly provisioned and released with minimal management effort or service provider interaction. Cloud computing may include location-independent computing, whereby shared servers provide resources, software, and data to computers and other devices on demand. For more information regarding cloud computing, see the NIST's (National Institute of Standards and Technology) definition of cloud computing at http://csrc.nist.gov/publications/nistpubs/800-145/SP800-145.pdf (last visited June 2012), which is hereby incorporated by reference in its entirety.

As used herein, "transmit" may include sending electronic data from one system component to another over a network connection. Additionally, as used herein, "data" may include encompassing information such as commands, queries, files, data for storage, and the like in digital or any other form.

The system contemplates uses in association with web services, utility computing, pervasive and individualized computing, security and identity solutions, autonomic computing, cloud computing, commodity computing, mobility and wireless solutions, open source, biometrics, grid computing and/or mesh computing.

One skilled in the art will also appreciate that, for security reasons, any databases, systems, devices, servers or other components of the system may consist of any combination thereof at a single location or at multiple locations, wherein each database or system includes any of various suitable security features, such as firewalls, access codes, encryption, decryption, compression, decompression, and/or the like.

The computers discussed herein may provide a suitable website or other Internet-based graphical user interface which is accessible by users. In one embodiment, the MICROSOFT® INTERNET INFORMATION SERVICES® (IIS), MICROSOFT® Transaction Server (MTS), and MICROSOFT® SQL Server, are used in conjunction with the MICROSOFT® operating system, MICROSOFT® NT web server software, a MICROSOFT® SQL Server database system, and a MICROSOFT® Commerce Server. Additionally, components such as Access or MICROSOFT® SQL Server, ORACLE®, Sybase, Informix MySQL, Interbase, etc., may be used to provide an Active Data Object (ADO) compliant database management system. In one embodiment, the Apache web server is used in conjunction with a Linux operating system, a MySQL database, and the Perl, PHP, and/or Python programming languages.

Any of the communications, inputs, storage, databases or displays discussed herein may be facilitated through a website having web pages. The term "web page" as it is used herein is not meant to limit the type of documents and applications that might be used to interact with the user. For example, a typical web site might include, in addition to standard HTML documents, various forms, JAVA APPLE® ts, JAVASCRIPT, active server pages (ASP), common gateway interface scripts (CGI), extensible markup language (XML), dynamic HTML, cascading style sheets (CSS), AJAX (Asynchronous JAVASCRIPT And XML), helper applications, plug-ins, and the like. A server may include a web service that receives a request from a web server, the request including a URL and an IP address (123.56.789.234). The web server retrieves the appropriate web pages and sends the data or applications for the web pages to the IP address. Web services are applications that are capable of interacting with other applications over a communications means, such as the internet. Web services are typically based on standards or protocols such as XML, SOAP, AJAX, WSDL and UDDI. Web services methods are well known in the art, and are covered in many standard texts. See, e.g., Alex Nghiem, IT Web Services: a Roadmap for the Enterprise (2003), hereby incorporated by reference.

Middleware may include any hardware and/or software suitably configured to facilitate communications and/or process transactions between disparate computing systems. Middleware components are commercially available and known in the art. Middleware may be implemented through commercially available hardware and/or software, through custom hardware and/or software components, or through a combination thereof. Middleware may reside in a variety of configurations and may exist as a standalone system or may be a software component residing on the Internet server. Middleware may be configured to process transactions between the various components of an application server and any number of internal or external systems for any of the purposes disclosed herein. WEBSPRERE MQ™ (formerly MQSeries) by IBM®, Inc. (Armonk, N.Y.) is an example of a commercially available middleware product. An Enterprise Service Bus ("ESB") application is another example of middleware.

Practitioners will also appreciate that there are a number of methods for displaying data within a browser-based document. Data may be represented as standard text or within a fixed list, scrollable list, drop-down list, editable text field, fixed text field, pop-up window, and the like. Likewise, there are a number of methods available for modifying data in a web page such as, for example, free text entry using a keyboard, selection of menu items, check boxes, option boxes, and the like.

The system and method may be described herein in terms of functional block components, screen shots, optional selections and various processing steps. It should be appreciated that such functional blocks may be realized by any number of hardware and/or software components configured to perform the specified functions. For example, the system may employ various integrated circuit components, e.g., memory elements, processing elements, logic elements, look-up tables, and the like, which may carry out a variety of functions under the control of one or more microprocessors or other control devices. Similarly, the software elements of the system may be implemented with any programming or scripting language such as C, C++, C#, JAVA, JAVASCRIPT, VBScript, Macromedia Cold Fusion, COBOL, MICROSOFT® Active Server Pages, assembly, PERL, PHP, awk, Python, Visual Basic, SQL Stored Procedures, PL/SQL, any UNIX shell script, and extensible markup language (XML) with the various algorithms being implemented with any combination of data structures, objects, processes, routines or other programming elements. Further, it should be noted that the system may employ any number of conventional techniques for data transmission, signaling, data processing, network control, and the like. Still further, the system could be used to detect or prevent security issues with a client-side scripting language, such as JAVASCRIPT, VBScript or the like. For a basic introduction of cryptography and network security, see any of the following references: (1) "Applied Cryptography: Protocols, Algorithms, And Source Code In C," by Bruce Schneier, published by John Wiley & Sons (second edition, 1995); (2) "JAVA Cryptography" by Jonathan Knudson, published by O'Reilly & Associates (1998); (3) "Cryptography & Network Security: Principles & Practice" by William Stallings, published by Prentice Hall; all of which are hereby incorporated by reference.

As will be appreciated by one of ordinary skill in the art, the system may be embodied as a customization of an existing system, an add-on product, a processing apparatus executing upgraded software, a stand-alone system, a distributed system, a method, a data processing system, a device for data processing, and/or a computer program product. Accordingly, any portion of the system or a module may take the form of a processing apparatus executing code, an internet based embodiment, an entirely hardware embodiment, or an embodiment combining aspects of the internet, software and hardware. Furthermore, the system may take the form of a computer program product on a computer-readable storage medium having computer-readable program code means embodied in the storage medium. Any suitable computer-readable storage medium may be utilized, including hard disks, CD-ROM, optical storage devices, magnet 110*ic* storage devices, and/or the like.

Systems, methods and computer program products are provided. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in various embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112 (f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A quick release device comprising:

a shade bracket having an inside facing a shade tube and a back side facing away from the shade tube;

a shaft having a first portion extending inward of the inside of the shade bracket;

a hub received over an end of the first portion of the shaft;

an end of the shade tube being engaged with the hub;

a shade wound around the shade tube, wherein the shade tube is configured to rotate with the shaft to wind and unwind the shade from the shade tube;

a gear wheel engaging with the first portion of the shaft and positioned inside the shade tube;

a pawl inside the shade tube and removably engaging with the gear wheel; and a solenoid inside the shade tube and configured to activate the pawl, wherein activation of the pawl disengages the pawl from the gear wheel and allows the shaft to rotate.

2. The device of claim 1, further comprising a pulsing system to pulse the pawl and control a descent of the shade.

3. The device of claim 1, wherein the shaft is located over a window, and wherein the shaft rotates until the shade attached to the shaft completely covers the window, based on a pre-set that causes the shade to stop at a particular location that completely covers the window.

4. The device of claim 1, further comprising a control system to send a notification upon the activation of the pawl.

5. The device of claim 1, further comprising an activation app on a smartphone, wherein the activation app communicates with a control system to initiate the activation of the pawl.

6. The device of claim 1, further comprising a control card in communication with the solenoid, wherein the control card communicates via at least RF or low voltage communication network and a power source configured to provide power to the solenoid, wherein the power source is at least one of a solar panel or a battery.

7. The device of claim 1, wherein the shaft is located over a window, and wherein the shaft rotates until the shade attached to the shaft partially covers the window at a pre-set location, based on a pre-set that causes the shade to stop at the pre-set location.

8. The device of claim 1, further comprising a spacer, a bearing, and a bearing housing.

9. The device of claim 1, further comprising a dampening brake to control a descent of the shade.

* * * * *